US006024028A

United States Patent [19]

Simonen

[11] Patent Number: 6,024,028

[45] Date of Patent: Feb. 15, 2000

[54] PROTECTION OF THE AIR PORTS OF A RECOVERY BOILER

[75] Inventor: Jorma Simonen, Marietta, Ga.

[73] Assignee: Ahlstrom Machinery Oy, Helsinki, Finland

[21] Appl. No.: 09/038,059

[22] Filed: Mar. 11, 1998

Related U.S. Application Data

[60] Provisional application No. 60/039,605, Mar. 12, 1997.

[51] Int. Cl.[7] ..... F23L 5/00

[52] U.S. Cl. ..... 110/182.5; 110/238; 110/343; 239/591; 122/6.6

[58] Field of Search ..... 239/591; 110/182.5, 110/297, 309, 310, 313, 343, 349, 238; 122/6.5, 6.6

[56] References Cited

U.S. PATENT DOCUMENTS

| | | | |
|---|---|---|---|
| 1,862,341 | 6/1932 | Holzworth | 122/6.6 |
| 3,015,481 | 1/1962 | Clingensmith | 122/6.6 |
| 3,188,070 | 6/1965 | Lee | 110/182.5 X |
| 3,545,736 | 12/1970 | Zimmermann | 122/6.6 X |
| 3,589,318 | 6/1971 | Szatkowski | 110/182.5 |
| 3,831,857 | 8/1974 | Scott | 239/591 X |
| 3,845,729 | 11/1974 | Von Berlichingen | 110/182.5 X |
| 4,759,297 | 7/1988 | McNally et al. | 110/182.5 |
| 5,528,999 | 6/1996 | Salmi | 110/182.5 |

FOREIGN PATENT DOCUMENTS

| | | | |
|---|---|---|---|
| 54-124312 | 9/1979 | Japan | 239/591 |
| 8-188977 | 8/1996 | Japan . | |
| 351 029 | 1/1972 | Sweden . | |

*Primary Examiner*—Ira S. Lazarus
*Assistant Examiner*—Ljiljana V. Ciric
*Attorney, Agent, or Firm*—Nixon & Vanderhye P.C.

[57] ABSTRACT

A method and apparatus for extending the life of air ports and nozzles in furnaces, particularly recovery boilers for burning black liquor to produce heat and a chemical melt. Apparatus is provided for feeding combustion air into a furnace having a tube wall, the apparatus comprising: an air port disposed in the tube wall, and connected to an air duct through which air flows into and then through the air port, and into the furnace; and a protective insert of heat conductive and heat and corrosion resistant material mounted in the air port and positioned so that it is cooled by the air flowing through the air port. The protective insert has sufficient thermal mass (e.g. a volume of between 40,000–4,000,000 cubic mm) so as to effectively even out temperature peaks caused by melt splashes from the furnace impacting the vicinity of the air port, e. g. the protective insert is made out of highly corrosion resistant steel such as stainless steel. The air port may be defined by, or comprise, a nozzle having an interior and a bottom portion; and wherein the protective insert is preferably releasably mounted to the interior bottom portion of the nozzle in the air flow from an air duct to the furnace.

25 Claims, 2 Drawing Sheets

PROTECTION OF THE AIR PORTS OF A RECOVERY BOILER

CROSS-REFERENCE TO RELATED APPLICATION

This application claims the priority of Provisional 60/039,605 filed Mar. 12, 1997.

BACKGROUND AND SUMMARY OF THE INVENTION

The present invention relates to an apparatus for leading combustion air to a furnace, which apparatus comprises an air port disposed in the furnace. The air port is connected to an air distribution channel positioned outside the tube wall of the furnace, from which the air flows through the air port into the furnace.

Black liquor obtained from the production of chemical pulp is burnt in a recovery boiler. The air required for the combustion of the organic material in the black liquor is fed to the furnace of the boiler from air distribution channels disposed at various levels around the furnace, through the air ports in the wall of the furnace. Usually nozzles are disposed in the openings in the wall so as to direct air into the furnace. The air is most commonly introduced into the furnace at three levels. At the lowest level is the primary air level, above this, is a secondary air level, and the highest level, above the liquor nozzles, is the tertiary air level. There may also be more than three air levels in the boiler.

Air nozzles have been manufactured of different types of steel and are typically welded or fully cast. Nozzles manufactured of different refractory materials are also used. There are basically two structures that may be used in air nozzles. In one of these structures a nozzle is attached to a gas-tight air port opening formed by bending wall tubes, by for example welding a nozzle made of metal plates into the sides of said tubes. The nozzles may also be attached onto the tube panels by a screw joint. The nozzles are conventionally located inside a box filled with refractory material, the outer shell of which is a steel plate. The boxes are connected to the tube walls, and are usually filled with refractory material. The refractory material protects the nozzle structures and causes heat to move out of the nozzle.

In another embodiment, the nozzle is a distinct structure, and does not form a gas-tight or melt-tight structure with the wall of the boiler. This is a distinct disadvantage of this embodiment.

The combustion air is directed into the nozzles from air ducts encircling (surrounding) the boiler. The air ducts usually include air controlling devices for each of nozzles. The air passes through an air guide, and then an air nozzle, into the furnace.

Conventional air nozzles have a tendency to corrode and crack, and therefore require continuous maintenance in recovery boilers (soda and other types of boilers) burning waste liquors (e.g. black liquor) from the forest industry. This is especially true for the primary air nozzles in a recovery boiler. While the maintenance of the nozzles itself is expensive, a much more significant reason why the corrosion and cracking is dangerous is that nozzle damage may creep into the adjacent water-cooled tubes on the walls of the furnace of the boiler. A water leak in these tubes may cause a melt explosion in the boiler, with potentially disastrous consequences.

One significant reason for the above-mentioned corrosion and cracking of the nozzles and their surroundings is the splashing of the melt generated in the furnace into the air ports, especially into the primary air ports (which are located at the lowest level). The main components of the melt in a sulphate process are sodium carbonate and sodium sulphide. The melt splashes, which have a volume of at least several liters, cause rapid heating of the structure of the air port up to the melting point of the melt, so that the melt salts cause corrosion and erosion in the air ports.

Rapid changes in the nozzle temperature also generate thermal fatigue and stress corrosion in the structures of the air port and even in the surrounding tubes of the furnace. Studies have shown that the temperature of the primary air nozzle, when not properly cooled, varies very rapidly. For example, during the first two hours of a four-hour test period, the temperature varied substantially constantly between about 500 and 850° C. For the last two hours, the temperature dropped so that it was between about 350 and 500° C. most of the time, rising occasionally up to about 600° C. The temperature peaks indicate splashing of melt into the air nozzle.

The air ports and structures in the vicinity thereof are typically cooled by the combustion air being fed to the furnace. They get rapidly damaged if the feed of the combustion air from the port in question is interrupted by closing its respective air damper.

Repairs of air nozzles have to be done regularly during shutdowns. The repairs are difficult and laborious to effect. Dismantling of equipment is necessary and the removal of old nozzles is difficult and time-consuming. Therefore, the shutdowns often last a long time, causing losses in production.

According to the present invention is possible to provide an apparatus for feeding combustion air into the furnace in which the air ports and the structures of the wall of the furnace in the vicinity thereof are protected better than in the prior art against the effects of corrosion and temperature changes. The invention protects the air ports of a boiler burning waste liquor from pulp and paper industries (e.g. black liquor), for example the ports of a recovery boiler, from corrosion and cracking. The invention is especially useful in protecting the primary air ports closest to the melt bed, which are exposed to detrimental effects of the melt. In addition, the invention provides an apparatus that is easy to maintain and repair, so that it is possible to decrease repair and shutdown costs significantly.

According to the present invention the lower part of the air port is provided with a protective insert which is made of substantially heat-and-corrosion-resistant material and mounted and positioned in such a way that it is cooled by the air flowing through the port. That is, the apparatus according to the invention is provided with a separate thermal mass protective insert, so that temperature peaks caused by melt splashes can be effectively evened out, and the structures of the port (especially those at the bottom) can be effectively protected against corrosion and cracking. The protective insert is made of substantially corrosion-resistant material, for example of stainless steel or acid-proof steel. The elongated protective insert according to the invention is attached in such a way that it can be detached relatively easily and may be changed, when needed. The protective insert is also attached in such a way that changing it does not damage the point of attachment or the surroundings thereof. Typically, the insert is disposed at the lower part of the nozzle of the air port, so that it is not in contact with the wall tubes and so that the insert does not have to be detached from the wall tubes of the boiler when the insert is replaced.

The protective insert according to the invention is attached, for example by welding it lightly into the air port, in such a way that the temperature peaks do not cause cracking or corrosion of the cooling tubes of the furnace. Using the massive protective insert cooled by combustion air, cooling capacity may be stored up and then used to cool the structure when melt splashes occur. The protective inserts protect the air ports against the immediate attack of melt and, due to their heat capacity, cool a melt splash so that the temperature rise from a melt splash does not affect the structures surrounding the protective insert.

According to one aspect of the present invention, there is provided an apparatus for feeding combustion air into a furnace having a tube wall. The apparatus comprises: An air port disposed in the tube wall, and connected to an air duct through which air flows into and then through the air port, and into the furnace; and a protective insert of heat and corrosion resistant material mounted in the air port and positioned so that it is cooled by the air flowing through the air port. Preferably the protective insert has sufficient thermal mass so as to effectively even out temperature peaks caused by melt splashes from the furnace impacting the vicinity of the air port. For example, the protective insert is made out of highly corrosion resistant steel (such as stainless steel, or acid proof steel), or a like corrosion resistant high thermal conductivity material, and has a volume of between about 40,000–4,000,000 cubic mm (e.g. between about 1–2 million cubic mm).

The air port may be defined by (or the air port further comprises) a nozzle extending into the air duct the nozzle having an interior and a bottom portion; and the protective insert is preferably mounted to the interior bottom portion of the nozzle, and so that it can be easily replaced. The insert is not in contact with the tube walls.

The apparatus preferably further comprises a refractory filled box attached to the tube wall, the air port disposed within the box adjacent the tube wall.

Also, the insert preferably has an upper surface, most remote from the interior bottom portion; and the upper surface is either flat, or preferably convexly curved. The insert extends within the nozzle, away from the tube wall, a linear distance from the box about 100–700 mm, preferably about 150–500 mm. Also, the insert preferably has a height proportional to about 20–50 mm when the air port has a height of about 150–200 mm, and the insert tapers so that it has a smaller cross-sectional area more remote from the box than adjacent the box; that is the insert has a height which tapers so that it has a smaller cross-sectional area more remote from the tube wall than closer the tube wall. The largest cross-sectional area of the insert is typically about 10–50%, preferably about 15–30%, of the cross-sectional area of the air port within the insert.

According to another aspect of the invention, there is provided a recovery boiler for burning black liquor of a pulp and paper mill to produce heat and to recover chemicals therefrom. The recovery boiler comprises: A furnace having a tube wall, and a black liquor inlet. An air port disposed in the tube wall, and connected to an air duct through which air flows into and then through the air port, and into the furnace. A protective insert of heat and corrosion resistant heat conductive material mounted in the air port and positioned so that it is cooled by the air flowing through the air port; and wherein the protective insert has sufficient thermal mass so as to effectively even out temperature peaks caused by melt splashes as a result of black liquor burning in the furnace and impacting the vicinity of the air port.

According to yet another aspect of the invention there is provided a method of recovering heat and chemicals from black liquor produced by the chemical pulping of cellulose, utilizing a recovery boiler having a furnace with a tube wall, and air ports at least some of which contain nozzles leading from the air ports into an air duct, each nozzle having a bottom interior portion. The method comprises the steps of: (a) Causing air to flow from the air duct, through the nozzles and air ports into the furnace to provide combustion air. (b) Feeding black liquor into the furnace to combust with the combustion air to produce heat energy and produce a melt. (c) Mounting protective inserts of heat conductive corrosion resistant material in at least some of the nozzles on the bottom interior portions thereof, the inserts having sufficient thermal mass so that when cooled by air flowing through the nozzles they even out the temperature peaks caused by melt splashing onto structures in the vicinity of the air ports, and thereby increase the life of the air ports and nozzles; and (d) withdrawing melt from the furnace for chemical recovery. Step (c) is preferably practiced by readily releasably mounting the inserts in the nozzles, distinct from the tube wall; and the method comprises the further step of replacing the inserts when worn without disturbing the tube wall or having to replace the nozzles.

It is the primary object of the present invention to provide enhanced longevity for air ports and/or nozzles in recovery boilers, or the like. This and other objects will be clear from the detailed description and from the appended claims.

DETAILED DESCRIPTION OF THE DRAWINGS

Figure 1:
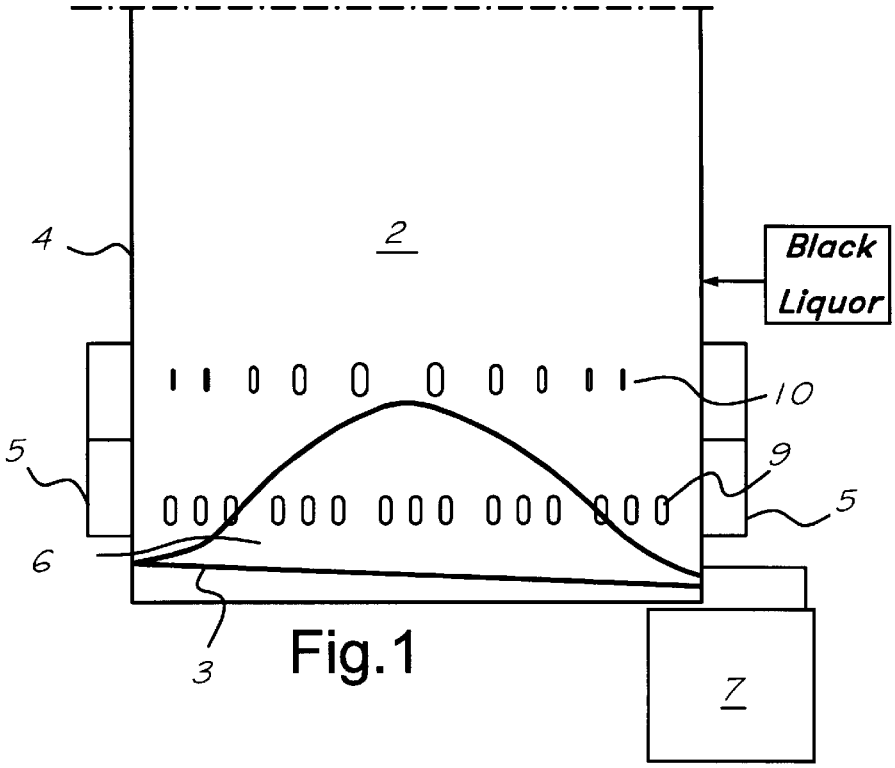
FIG. 1 schematically illustrates the lower part of a furnace in a recovery boiler.

The lower part of a furnace 2 of a recovery boiler according to the invention comprises a bottom 3 and walls 4 of the boiler. Black liquor is fed into the furnace, so that in the combustion process, a bed 6 is formed of dried and partly burnt liquor at the bottom of the boiler. The molten chemicals flow through the porous bed to the bottom of the furnace, and then they are passed as an overflow through melt chutes into the dissolver 7. Air is fed to the bottom of the furnace from two different levels: through primary air ports 9 and secondary air ports 10 from the air ducts 5 surrounding the boiler. At an upper level of the furnace 2 there are one or more other air levels. The feeding of air, and air feeding apparatus used for that purpose (for example air ducts), may utilize any conventional air controlling devices and air port cleaners.

The walls of the furnace 2 are constructed of water cooled tubes 11 connected to a conventional superheater and steam generating parts (not shown) of the recovery boiler. The required number of ports 9 have been positioned on the walls by bending adjacent tubes 11 apart, so that the ports 9 assume an elongated shape. An air nozzle 12 is positioned between the tubes 11, which nozzle 12 defines the air port 9. The nozzle 12 is connected to an air distributing channel 5 surrounding the boiler. The nozzle 12 is shaped in such a way that it is exactly suitable for the port 9. In this case, the nozzle 12 is, in addition, at the port 9 within a metal plate box 13, the box 13 being attached to the tube wall of the boiler. The box 13 is preferably filled with refractory material 20. The function of the refractory material 20 is to protect the structures 9, 12 and to conduct heat out of the nozzle 12.

From the bed 6, melt is splashed from time to time into the air port 9 (into the inside of the nozzle 12) and to the surroundings thereof in the furnace 2, so that these structures are exposed to the corroding effect of the melt and to the detrimental effects of the rapid rise in the temperature caused by the melt. The temperature in the bed is about 1,000–1,100° C. At this high temperature, in the presence of corroding substances, the nozzle 12 often becomes completely corroded. Thereafter, the refractory material 20 in the box 13 outside the nozzle 12 begins to get damaged under the influence of chemical attack. When the refractory material 20 deteriorates, the damage extends to the box 13, leading, in the worst case, to the shutting down and the repair of the entire boiler.

According to the present invention, the corrosion caused by splashing melt is inhibited by providing a massive protective insert 14 in the air port. In practice the insert 14 preferably is attached to the bottom of the nozzle 12 attached to the air port 9. The protective insert 14 is preferably made of a material which substantially resists the corrosion caused by the splashing melt. As the combustion air flows into the furnace 2 through the nozzle 12, the protective insert 14 is cooled by air. The insert 14 is able to store cooling capacity because of the high thermal mass thereof. Thus, due to the cooling effect of the protective insert 14, it is possible when melt splashes into the air port 9 to even out and prevent sudden detrimental rises in the temperature in the air port 9 and the structures in the vicinity thereof.

The protective insert 14 is preferably made of stainless steel or acid proof steel, or a like corrosion resistant but heat conductive material.

The protective insert 14 is constantly exposed to very corroding and hot conditions, so that it will wear away in the course of time. To maintain the functionality of the protective insert 14 the insert 14 should be replaced when needed. Therefore, the protective insert 14 is attached to the nozzle 12 in such a way that it may, if desired, be replaced by a new one. Attachment between the insert 14 and the nozzle 12 may be effected by light welding, conventional fasteners, or the like.

Figure 2:
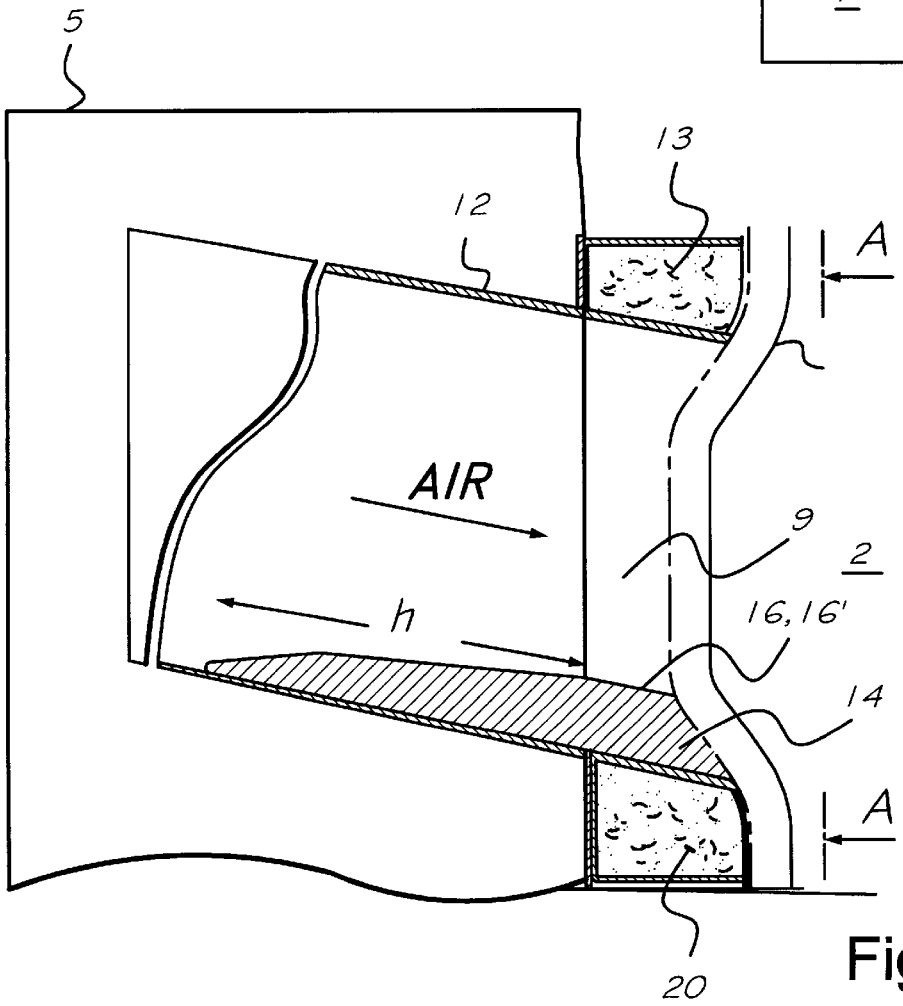
FIG. 2 schematically illustrates an embodiment according to the invention in which the air port and the protective insert disposed therein are shown in cross-section.

The protective insert 14 is preferably disposed in the nozzle 12 in such a way that it covers the lower part of the air port 9. The protective insert 14 may extend about 100–700 mm, preferably about 150–500 mm, from the furnace side of the air port 9 towards the air duct (distance h—see FIG. 2). The distance h the insert 14 extends depends on the size of the air port 9 and the requirements of an air port cleaner, which may be provided for cleaning of the port 9. The insert 14 may taper—as illustrated in FIG. 2—so that it has a smaller cross-sectional area more remote from the box 13 than adjacent the box 13. This tapering minimizes the disturbance of the air flow from duct 5 through nozzle 12 into the furnace 2.

The size of the protective insert 14 may vary according to the dimensioning of the air port 9. If the air port 9 is designed for a very heavy load of black liquor to be burnt in the boiler, but the boiler is in fact run with a significantly smaller load for a long time, the protective insert 14 is correspondingly larger. If the height of the air port is 150–200 mm, for example, the height of the protective insert is typically about 20–50 mm. A typical volume of the insert 14 is between 40,000 cubic mm–4,000,000 cubic mm, e.g. between about 1–2 million cubic mm. The largest cross-sectional area of the insert is typically about 10–50%, preferably about 15–30%, of the cross-sectional area of the air port within the insert.

Figure 3:
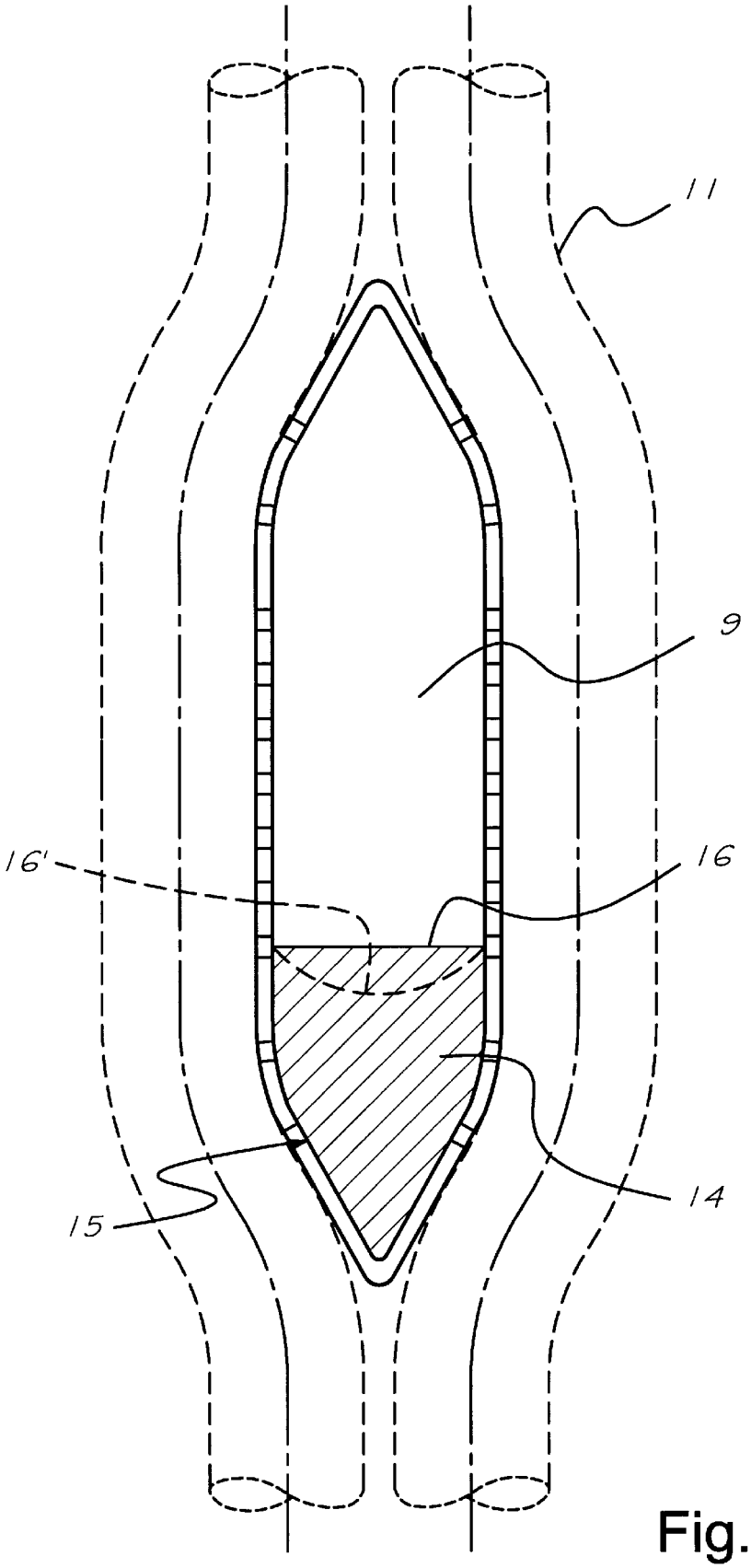
FIG. 3 illustrates the embodiment according to FIG. 2 seen from the inside of the furnace along line A—A.

FIG. 3 illustrates an air port formed between the bent wall tubes and a protective insert 14 seen from the side of the furnace 2. The lower surface 15 of the protective insert 14 is parallel with the corresponding form of the surface of the air port 9. The upper surface 16 of the insert 14 may be straight (flat as in solid line in FIG. 3) or convexly curved as indicated at 16' in dotted line in FIG. 3. If surface 16' is curved it protects the side walls of the air port 9 somewhat better.

The present invention presents a preferable and simple method of protecting a combustion air port 9 and the structures (e.g. nozzle 12) in the vicinity thereof against corrosion and heat damage caused by hot melt splashing. By using a protective insert 14 it is possible to use the nozzles 12 in air ports 9 longer than in the prior art.

The decrease in the repair shutdowns that ensues according to the invention results in significant cost savings. In addition, the operational safety of the boiler is improved, as apparatus damage in the vicinity of the melt may be prevented. The invention has been described in such a form that it is applicable especially to boilers burning waste liquor of chemical pulp mills, but it may also be applied to other combustion apparatus having corresponding conditions in the vicinity of its air ports.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for feeding combustion air into a furnace having a tube wall, said apparatus comprising:

an air port disposed in said tube wall, and connected to an air duct through which air flows into and then through the air port, and into said furnace; and a protective insert of heat resistant and corrosion resistant material mounted in said air port and positioned so that said protective insert is cooled by the air flowing through said air port, said protective insert has sufficient thermal mass so as to effectively even out temperature peaks caused by melt splashes from the furnace impacting the vicinity of said air port.

2. Apparatus as recited in claim 1 wherein said protective insert is made out of highly corrosion resistant steel.

3. Apparatus as recited in claim 2 wherein said protective insert has a volume of between about 40,000–4,000,000 cubic mm.

4. Apparatus as recited in claim 1 wherein said air port is defined by a nozzle having an interior bottom portion; and wherein said protective insert is mounted to said interior bottom portion of said nozzle.

5. Apparatus as recited in claim 4 wherein said insert is mounted by a connection to said air port so that said insert can be easily replaced.

6. Apparatus as recited in claim 4 wherein said insert is not in contact with said tube walls.

7. Apparatus as recited in claim 4 further comprising a refractory-filled box and positioned attached to said tube wall, said air port disposed within said box adjacent said tube wall.

8. Apparatus as recited in claim 7 wherein said insert extends within said nozzle, away from said tube wall, a linear distance from said box of about 100–700 mm.

9. Apparatus as recited in claim 8 wherein said insert has a maximum height of to about 20–50 mm when said air port has a height of about 150–200 mm.

10. Apparatus as recited in claim 8 wherein said insert tapers so that said insert has a smaller cross-sectional area more remote from said box than adjacent said box, and wherein the largest cross-sectional area of said insert is about 10–50% of the cross-sectional area of said air port without said insert.

11. Apparatus as recited in claim 4 wherein said insert has an upper surface, said upper surface most remote from said interior bottom portion; and wherein said upper surface is convexly curved.

12. Apparatus as recited in claim 1 wherein said insert is of stainless steel or acid proof steel.

13. Apparatus as recited in claim 1 further comprising a refractory-filled box and positioned attached to said tube wall, said air port disposed within said box adjacent said tube wall.

14. Apparatus as recited in claim 1 wherein said air port further comprises a nozzle extending into said air duct, said nozzle having an interior and bottom portion; and wherein said protective insert is mounted to said interior bottom portion of said nozzle, and extends within said nozzle a distance of between about 150–500 mm.

15. Apparatus as recited in claim 14 wherein the largest cross-sectional area of said insert is about 10–50% of the cross-sectional area of said air port without said insert.

16. Apparatus as recited in claim 14 wherein said insert has a height which tapers so that said insert has a smaller cross-sectional area more remote from said tube wall than closer to said tube wall.

17. Apparatus as recited in claim 14 wherein said insert has an upper surface, said upper surface most remote from said interior bottom portion; and wherein said upper surface is convexly curved.

18. A recovery boiler for burning black liquor of a pulp and paper mill to produce heat and to recover chemicals from the black liquor, said recovery boiler comprising:

a furnace having a tube wall, and a black liquor inlet;

an air port disposed in said tube wall, and connected to an air duct through which air flows into and then through the air port, and into said furnace;

a protective insert of heat resistant and corrosion resistant heat conductive material mounted in said air port and positioned so that said insert is cooled by the air flowing through said air port; and wherein said protective insert has sufficient thermal mass so as to effectively even out temperature peaks caused by melt splashes as a result of black liquor burning in said furnace and impacting the vicinity of said air port.

19. A recovery boiler as recited in claim 18 wherein said protective insert is made out of highly corrosion resistant steel and has a volume between 40,000–4,000,000 cubic millimeters.

20. A recovery boiler as recited in claim 18 wherein said air port further comprises nozzle extending into said air duct, said nozzle having an interior and a bottom portion; and wherein said protective insert is mounted to said interior bottom portion of said nozzle, and extends within said nozzle a distance of between about 150–500 mm.

21. A recovery boiler as recited in claim 20 further comprising a refractory filled box and positioned attached to said tube wall, said air port disposed within said box adjacent said tube wall; and wherein said insert tapers so that said insert has a smaller cross-sectional area more remote from said box than adjacent said box; and wherein the largest cross-sectional area of said insert is about 10–50% of the cross-sectional area of said air port without said insert.

22. Apparatus for feeding combustion air into a furnace having a tube wall, said apparatus comprising:

an air port disposed in said tube wall, and connected to an air duct through which air flows into and then through the air port, and into said furnace;

a protective insert of heat and corrosion resistant material mounted in said air port and positioned so that said insert is cooled by the air flowing through said air port;

wherein said air port further comprises a nozzle extending into said air duct, said nozzle having an interior bottom portion and an interior top portion; and wherein said protective insert is mounted to said interior bottom portion of said nozzle and spaced from said interior top portion, and extends within said nozzle a distance of between about 150–500 mm.

23. Apparatus as recited in claim 22 wherein the largest cross-sectional area of said insert is about 10–50% of the cross-sectional area of said air port without said insert.

24. Apparatus as recited in claim 22 wherein said insert has a height which tapers so that said insert has a smaller cross-sectional area more remote from said tube wall than closer to said tube wall.

25. Apparatus as recited in claim 22 wherein said insert has an upper surface, most remote from said interior bottom portion; and wherein said upper surface is convexly curved.

* * * * *